US009267321B2

(12) United States Patent
Ogawa et al.

(10) Patent No.: US 9,267,321 B2
(45) Date of Patent: Feb. 23, 2016

(54) INTERLOCKING MECHANISM AND IMAGE FORMING APPARATUS HAVING THE INTERLOCKING MECHANISM

(71) Applicants: Masato Ogawa, Kanagawa (JP); Shinichiro Naruse, Kanagawa (JP)

(72) Inventors: Masato Ogawa, Kanagawa (JP); Shinichiro Naruse, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/629,609

(22) Filed: Feb. 24, 2015

(65) Prior Publication Data

US 2015/0247359 A1 Sep. 3, 2015

(30) Foreign Application Priority Data

Feb. 28, 2014 (JP) ..... 2014-038931

(51) Int. Cl.
*E06B 7/28* (2006.01)
*E06B 3/36* (2006.01)
*G03G 21/16* (2006.01)

(52) U.S. Cl.
CPC ..... *E06B 3/362* (2013.01); *G03G 21/1633* (2013.01); *G03G 21/1647* (2013.01)

(58) Field of Classification Search
CPC ..... G03G 21/1633; G03G 21/1647; G03G 2221/169
USPC ..... 399/107, 110, 114; 200/320
See application file for complete search history.

(56) References Cited

U.S. PATENT DOCUMENTS 4,978,817 A * 12/1990 Honda ..... G03G 15/80 200/50.1
6,448,994 B1 * 9/2002 Kim ..... G03G 21/1633 347/228
8,611,783 B2 * 12/2013 Onuma ..... G03G 21/1633 200/320
2002/0114633 A1 * 8/2002 Sawanaka ..... G03G 21/1633 399/9
2003/0170047 A1 * 9/2003 Yoshida ..... G03G 15/50 399/110
2007/0283624 A1 * 12/2007 Yasumoto ..... B41J 29/13 49/31
2008/0205953 A1 * 8/2008 Takemoto ..... G03G 21/16 399/397
2010/0050527 A1 * 3/2010 Nobuta ..... B41J 29/13 49/31
2010/0239307 A1 * 9/2010 Onuma ..... G03G 15/80 399/107
2011/0182614 A1 * 7/2011 Onuma ..... G03G 21/1633 399/110
2013/0287434 A1 * 10/2013 Hisano ..... G03G 21/1633 399/110

FOREIGN PATENT DOCUMENTS

JP H10-162684 6/1998
JP H11-305512 11/1999

* cited by examiner

*Primary Examiner* — Katherine Mitchell
*Assistant Examiner* — Justin Rephann
(74) *Attorney, Agent, or Firm* — IPUSA, PLLC

(57) ABSTRACT

An interlocking mechanism includes an axial member reciprocating in a width direction of arrangement of first and second front doors by linking with an opening/closing operation of a side door. A stop member is provided rotatably and fixed in the width direction to the axial member. A restriction member presses the axial member toward the side door and having a pressing/urging member that urges the stop member in one of rotating directions. A pressing claw presses the stop member in the other of the rotating directions in a state where the second front door and the side door are closed. A restriction claw abuts on the stop member when the first front door is closed in a state where at least one of the side door and the second front door is open. An interlock switch is actuated by an actuator being inserted into the interlock switch.

10 Claims, 8 Drawing Sheets

INTERLOCKING MECHANISM AND IMAGE FORMING APPARATUS HAVING THE INTERLOCKING MECHANISM

CROSS-REFERENCE TO RELATED APPLICATION

The present application is based upon and claims the benefit of priority of Japanese Patent Application No. 2014-038931, filed on Feb. 28, 2014, the entire contents of which are incorporated herein by reference.

BACKGROUND OF THE INVENTION

1. Field of the Invention

The present invention generally relates to an interlocking mechanism and an image forming apparatus having an interlocking mechanism.

2. Description of the Related Art

There is a case where an apparatus having an openable/closable door is provided with an interlocking mechanism so that devices provided inside the apparatus are not actuated while the door is open. Such an interlocking mechanism includes, for example, an actuator provided to a cover and an interlocking switch provided to an apparatus body, wherein, when a door is closed and the actuator is inserted into the interlocking switch, the devices inside the apparatus are set in an actuatable state. If the apparatus has a plurality of doors, the interlocking mechanism may be provided individually for each of the doors, which may increase a number of parts and a manufacturing cost of the apparatus and make the structure of the apparatus complicated.

Thus, there is suggested, for example, in Japanese Laid-Open Patent Application No. H10-162684, a structure with which a single interlocking apparatus can deal with two doors provided on side surfaces of an apparatus body substantially perpendicular to each other. In this structure, the two doors must be located close to each other, and, thereby, it may be difficult to deal with a plurality of doors that are located remote from each other.

Accordingly, it is desirous to provide an interlocking mechanism having a simplified structure, which can deal with a plurality of doors located remote from each other, without increasing a manufacturing cost of an apparatus to which the interlocking mechanism is incorporated.

SUMMARY OF THE INVENTION

There is provided according to an aspect of the present invention an interlocking mechanism configured to be provided to a housing having a rotatable first front door, a rotatable second front door and a rotatable side door, both the first and second front doors being arranged on a front surface of the housing to constitute a double door. An axial member is configured to be provided on the front surface of the housing and reciprocate in a width direction of arrangement of the first and second front doors by linking with an opening/closing operation of the side door. A plate-shaped stop member is provided rotatably and fixed in the width direction to the axial member. A restriction member is configured to press the axial member toward the side door and has a pressing/urging member that urges the stop member in one of rotating directions. A pressing claw is provided on a backside of the second front door and configured to press the stop member in the other of the rotating directions in a state where the second front door and the side door are closed. A restriction claw is provided on a backside of the first front door and configured to abut on the stop member when the first front door is closed in a state where at least one of the side door and the second front door is open. An interlock switch is provided on the front surface of the housing and configured to be actuated by an actuator provided on the backside of the first front door being inserted into the interlock switch.

There is provided according to another aspect of the invention an image forming apparatus including an image forming part and the above-mentioned interlocking mechanism, wherein the interlock switch of the interlocking mechanism interlocks the image forming part.

Other objects, features and advantages of the present invention will become more apparent from the following detailed description when read in conjunction with the accompanying drawings.

The objects and advantages of the invention will be realized and attained by means of the elements and combinations particularly pointed out in the claims.

It is to be understood that both the foregoing general description and the following detailed description are exemplary and explanatory and not restrictive of the invention.

DETAILED DESCRIPTION OF THE EMBODIMENTS

Figure 1:
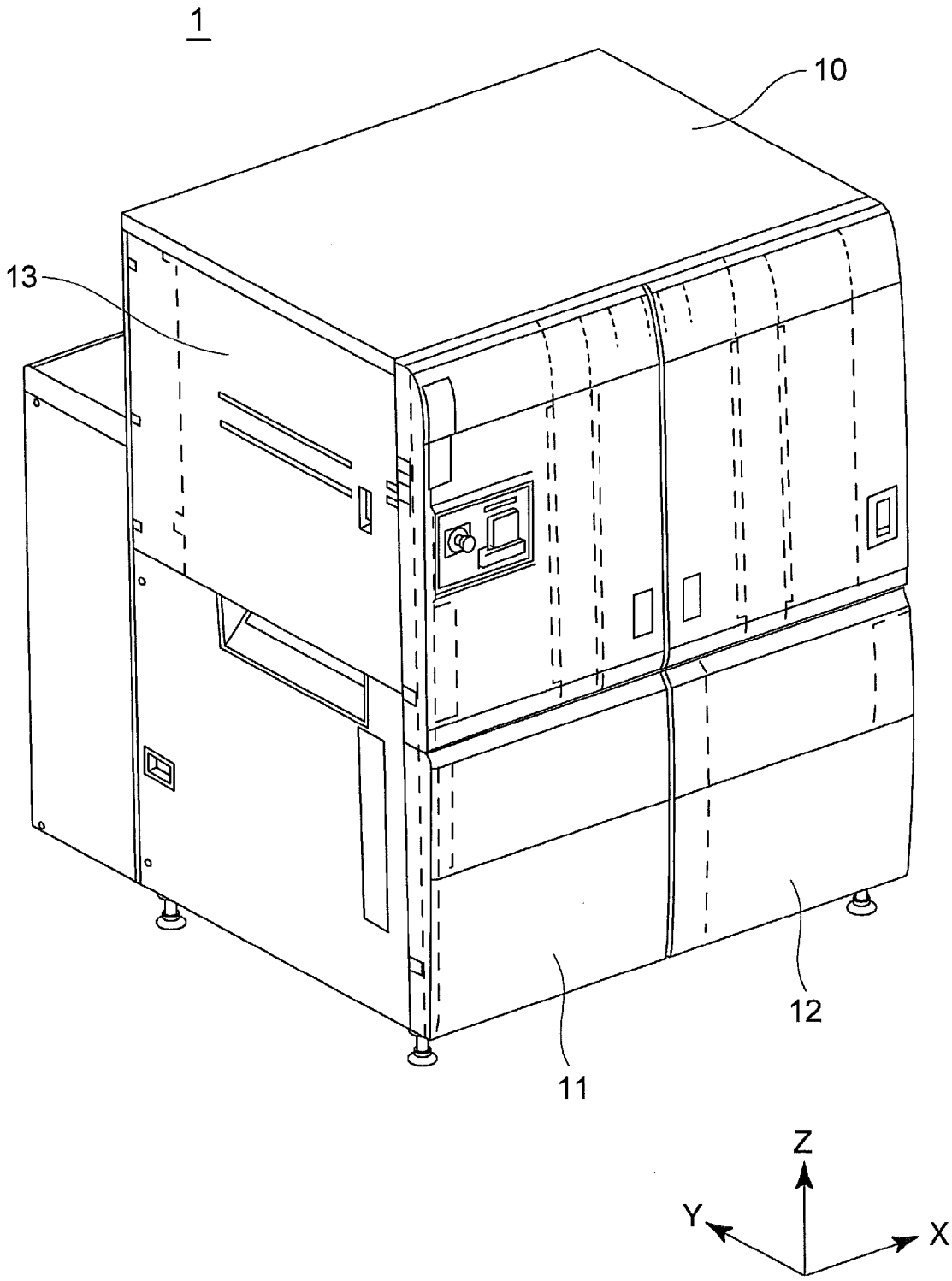
FIG. 1 is a perspective view of an image forming apparatus according to an embodiment.

A description will now be given, with reference to the drawings, of embodiments of the present invention. In those drawings, the same parts are given the same reference numerals, and descriptions thereof may be omitted.

FIG. 1 is a perspective view illustrating an image forming apparatus 1 according to an embodiment. In the figures mentioned below, the X-direction indicates a direction of width of the image forming apparatus 1, the Y-direction indicates a direction of depth of the image forming apparatus, and the Z-direction indicates a direction of height of the image forming apparatus 1.

The image forming apparatus 1 is an inkjet recording apparatus incorporating therein an image forming part for printing an image on a recording medium according to an inkjet method. The image forming part may be a device that forms an image according other image forming methods such as an electrophotography method.

The image forming apparatus 1 is provided with a first front door 11 and a second front door 12 on the front face of a generally rectangular housing 10. The first front door 11 and the second front door 12 are arranged side by side in X-direction so as to form a double door. Each of the first front door 11 and the second front door 12 is openable and closable by being rotated about one side thereof. Additionally, a side door 13 is provided on a side face of the housing 10 on the side of the first front door 11. The side door is also openable and closable by being rotated about one side thereof.

Figure 2:
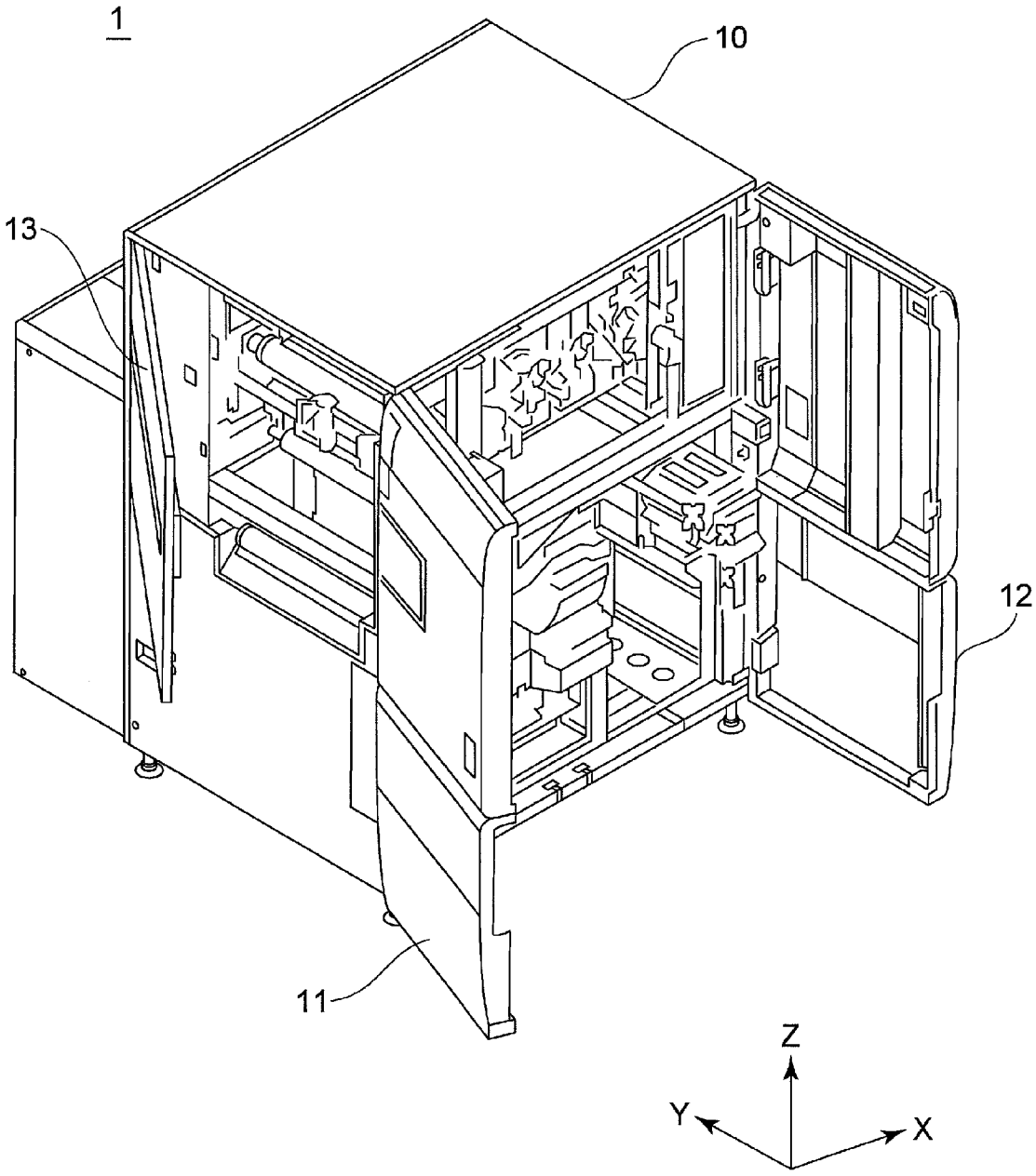
FIG. 2 is a perspective view of the image forming apparatus in a state where doors are open.

FIG. 2 is a perspective view of the image forming apparatus in a state where the first front door 11, second front door 12 and side door 13 are open.

As illustrated in FIG. 2, the first and second front doors 11 and 12 are rotatably supported by support axes provided on opposite sides of the housing, respectively, to open. The side door 13 is rotatably supported by a support axis on the backside of the housing 10 to open.

The image forming apparatus 1 is provided with an image forming part situated inside the housing 10. Thus, in order to prevent an unintentional operation of the image forming part, an interlocking mechanism is provided so that the image forming part cannot be actuated in a state where any one of the first front door 11, second front door 12 and side door 13 is open.

Figure 3:
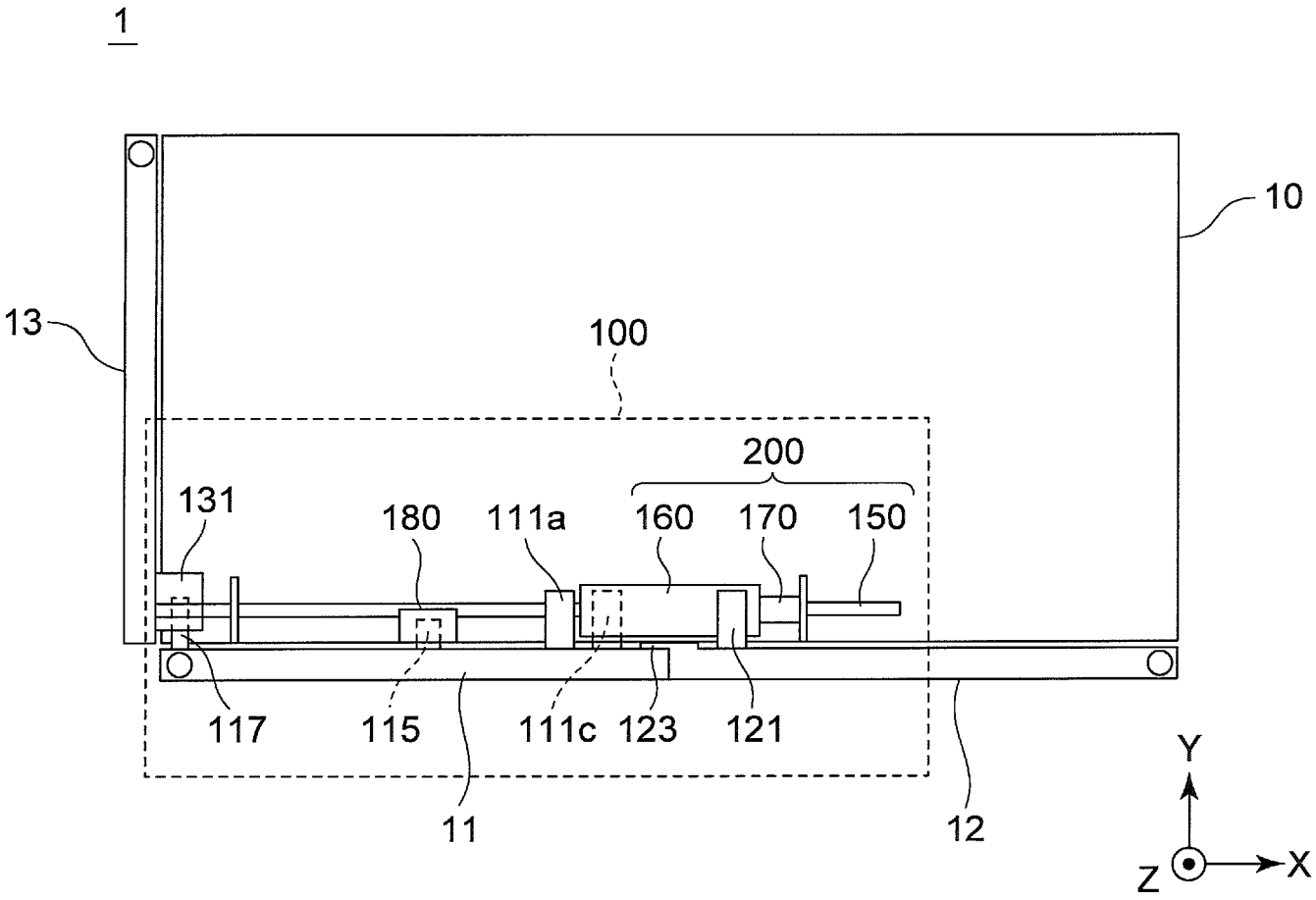
FIG. 3 is a plan view of an interlocking mechanism provided in the image forming apparatus.
Figure 4:
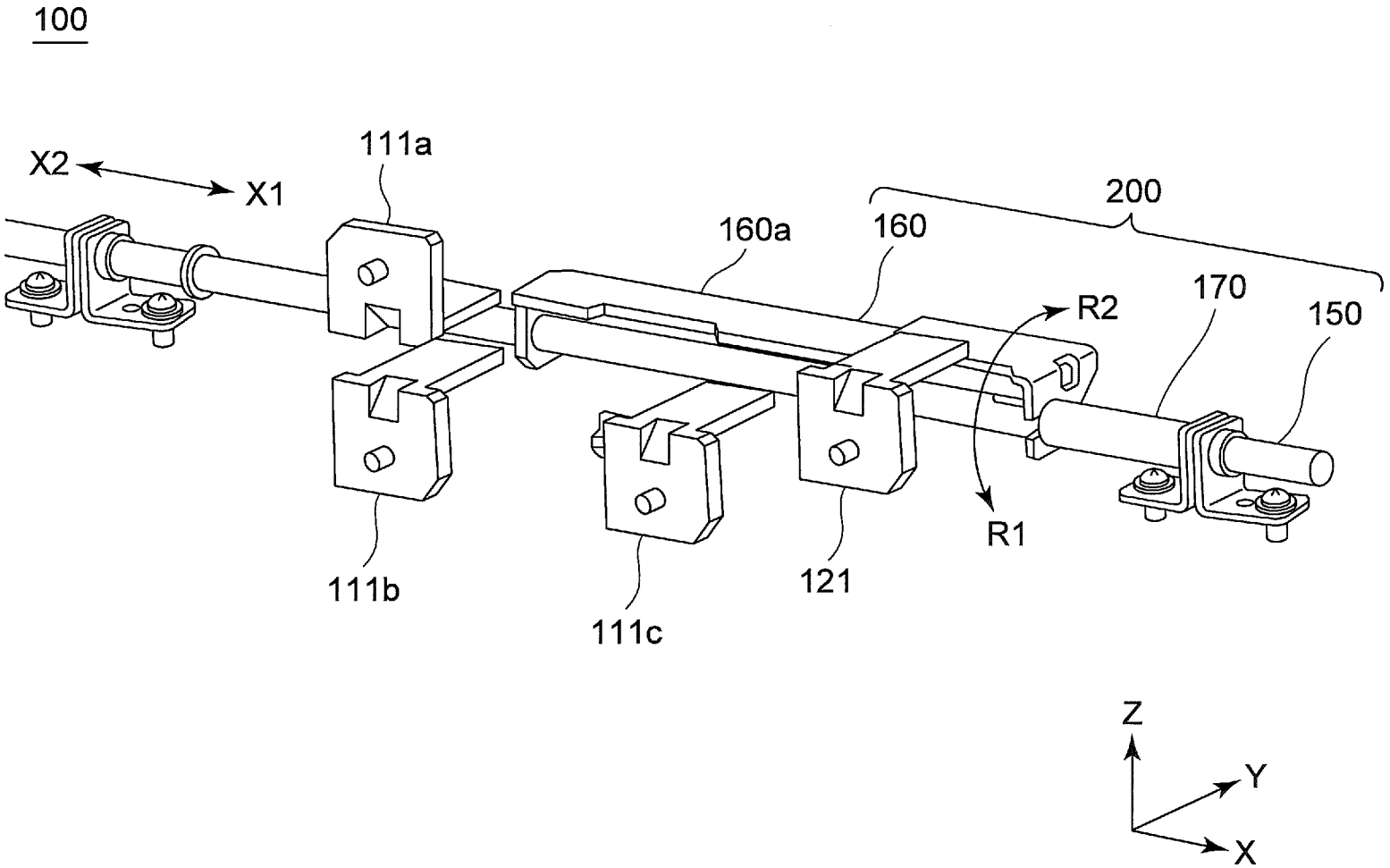
FIG. 4 is a perspective view of the interlocking mechanism.
Figure 5:
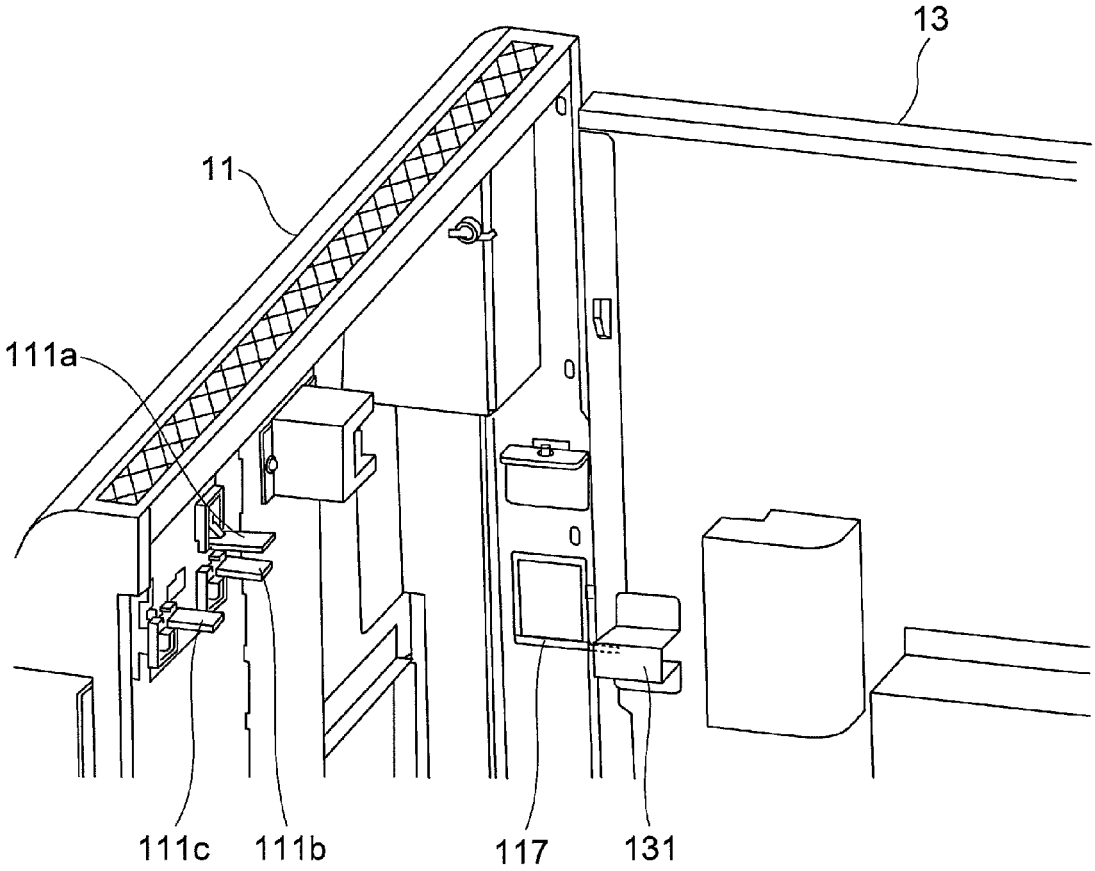
FIG. 5 is a perspective view of a fixing mechanism provided in the image forming apparatus.

Next, a description is given, with reference to FIGS. 3 through 5, of a structure of the interlocking mechanism 100. FIG. 3 is a plan view of the interlocking mechanism 100 provided in the image forming apparatus 1. FIG. 4 is a perspective view of the interlocking mechanism 100. FIG. 5 is a perspective view of a fixing mechanism provided in the image forming apparatus 1 to fix the first front door 11 and the side door 13 to each other.

As illustrated in FIG. 3, the image forming apparatus 100 is provided with an interlocking mechanism 100 on a front side of the housing 10. The interlacing mechanism 100 is provided on an upper part of the front surface of the housing 10 so that, for example, a user does not contact with a harness, etc.

The interlocking mechanism 100 includes an actuator 115 protruding from the backside of the first front door 11 and an interlock switch 180 provided on the front surface of the housing 10.

The interlock switch 180 is connected to the image forming part inside the housing 10. The interlock switch 180 functions to permit an actuation of the image forming part when the first front door 11 is closed and the actuator 115 is inserted into the interlock switch. On the other hand, the interlock switch 180 functions to prevent the image forming part from actuating when the first front door is open and the actuator 115 is removed from the interlock switch 180.

As illustrated in FIGS. 3 and 4, the interlocking mechanism 100 further includes a restriction member 200, restriction claws 111*a*, 111*b* and 111*c* and a pressing claw 121. The restriction claws 111*a*, 111*b* and 111*c* are provided on the backside of the first front door 11. The pressing claw 121 is provided on the backside of the second front door 12.

The restriction member 200 includes an axial member 150, a stop member 160 and a pressing/urging member 170.

The axial member 150 is movably provided in X-direction in an upper portion of the front surface of the housing 10, and has a length longer than or equal to the width of the first front door 11 in X-direction. The axial member 150 is reciprocable in X-direction by linking with the opening/closing operation of the side door 13. An end of the axial member 150 on the side of the side door 13 is pressed by the backside of the side door 13 when the side door 13 is closed, and the axial member 150 is moved in X1-direction indicated by arrow in FIG. 4. On the other hand, when the side door 13 is open, the axial member 150 is moved in X2-direction indicated by arrow in FIG. 4 by being pressed by the pressing/urging member 170.

The stop member 160, which is a plate-shaped member, is provided rotatably about the longitudinal axis of the axial member 150 and fixed in X-direction. The stop member 160 is urged in R1-direction indicated by arrow in FIG. 4 by the pressing/urging member 170. The stop member 160 is moved in X1-direction together with the axial member 150 when the side door 13 is closed. The stop member 160 is moved in R2-direction indicated by arrow in FIG. 4, when the second front door 12 is closed, because a plate part 160*a* of the stop member 160 is pressed by the pressing claw 121 provided on the backside of the second front door 12.

The pressing/urging member 170 abuts against the side surface of the stop member 160 and presses the axial member 150 together with the stop member 160 in X2-direction indicated in FIG. 4. The pressing/urging member 170 urges the rotatable stop member 160 in R1-direction. The pressing/urging member 170 is a torsion coil spring having a coil part into which the axial member 150 is inserted. The coil part is formed by a metal wire being wound so as to be elongated and contracted in X-direction. The opposite ends of the metal wire forming the coil part are fixed to the stop member 160 and the housing 10, respectively.

As illustrated in FIGS. 3 and 5, the interlocking mechanism 100 further includes a fixing mechanism including a fixing pin 117 and a fixing cover 131. The fixing pin 117 is provided on the backside of the first front door 11. The fixing cover 131 is provided on the backside of the side door 13. When the first front door 11 is closed in a state where the side door 13 is closed, the fixing pin 117 is inserted between the backside of the side door 13 and the fixing cover 131, and the side door 13 is fixed by the first front door 11. According to the above-mentioned fixing mechanism, the side door 13 cannot be open unless the first front door 11 is open. Note that the fixing is not limited to the above-mentioned mechanism, and can be any mechanism if such a mechanism can fix the side door 13 to the first front door 11.

The interlocking mechanism 100 further includes a collar part 123 provided on the second front door 12. The collar part 123 protrudes from the backside of the first front door 11 to the backside of the first front door when the first and second front doors 11 and 12 are closed. When the second front door 12 is opened in the state where the first and second front doors 11 and 12 are closed, the collar part 123 is engaged with the first front door 11, and, thereby, the first front door 11 is also opened together with the second front door 12.

As mentioned above, the image forming apparatus 1 is configured and arranged so that, when the second front door 12 is opened in the state where all doors are closed, the first front door 11 is also opened. Additionally, in order to open the side door 13, the first door 13 is necessarily opened beforehand.

Accordingly, when the second front door 12 or the side door 13 is open, the first front door is also set in the opened state and the actuator 115 is removed from the interlock switch 180, which sets the image forming apparatus 1 in a state where the image forming part cannot be actuated. Of course, when the first front door 11 is open, the actuator 115 is removed from the interlock switch 180, which sets the image forming apparatus 1 in the state where the image forming part cannot be actuated.

As mentioned above, in the image forming apparatus 1, when any one of the doors is open, the actuator 115 is removed from the interlock switch 180, which causes the image forming part to be prevented from being actuated. Accordingly, the image forming part incorporated in the image forming apparatus 1 cannot be actuated in the state where any one of the doors is open, thereby maintaining the safety.

A description is given below of operations of the interlocking mechanism 100 performed during a time period from a time when all of the first front door 11, second front door 12 and side door 13 are caused to be closed in the state where these doors are open and until a time when the interlock switch 180 is actuated and the image forming part is set in the operable state.

Figure 6:
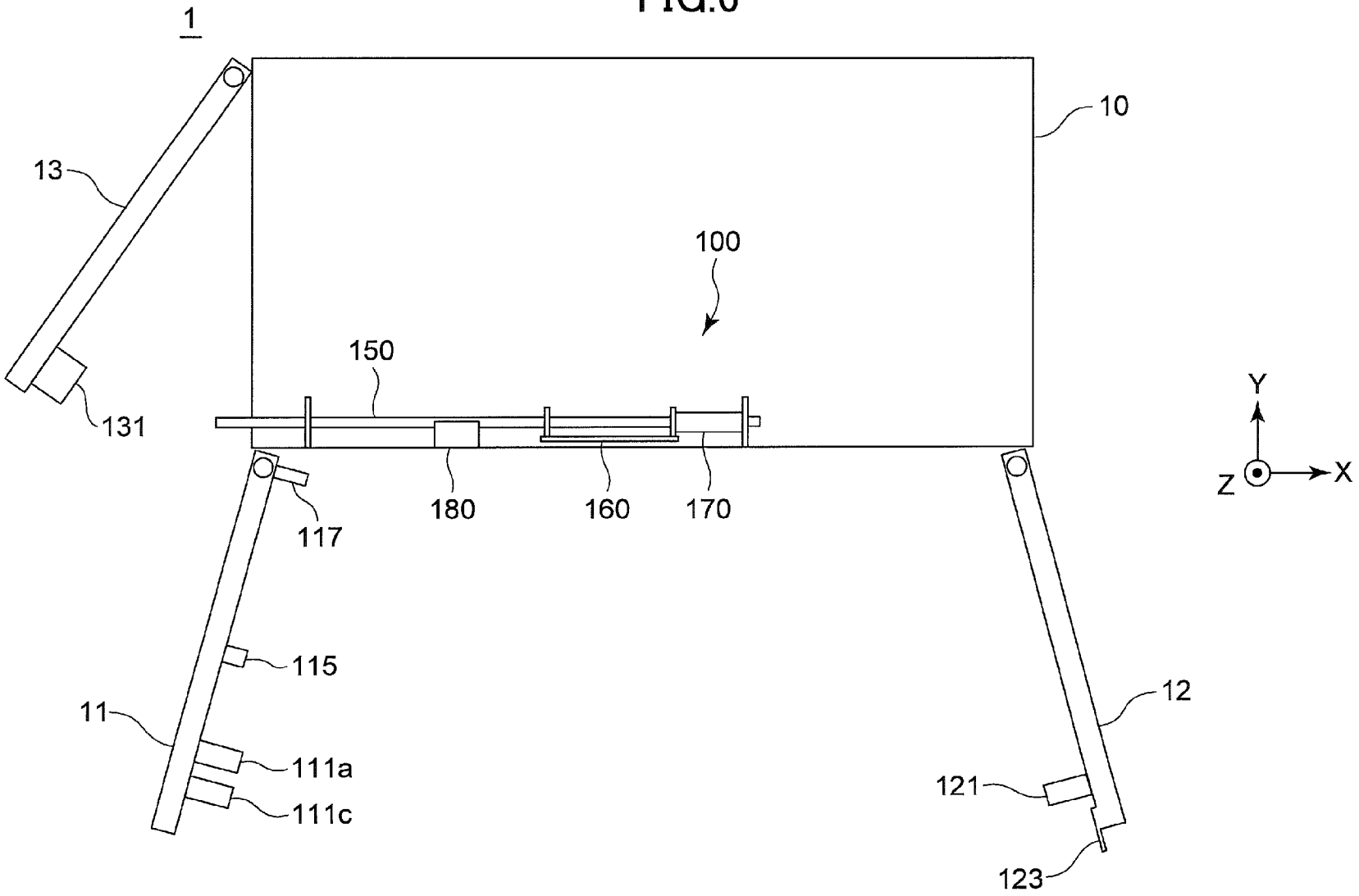
FIG. 6 is an illustration for explaining an operation of the interlocking mechanism.

FIG. 6 illustrates the image forming apparatus 1 and interlocking mechanism 100 in the state where the first front door 11, second front door 12 and side door 13 are open.

As illustrated in FIG. 6, when the side door 13 is open, the axial member 150 and stop member 160 of the interlocking mechanism 100 are pressed by the pressing/urging member 170 and moved to the side door 13 side. When the second front door 12 is open, the stop member 160 is urged by the pressing/urging member 170 and rotated in R1-direction indicated in FIG. 4. Thereby, the plate part 160*a* is positioned substantially parallel to XZ-plane.

In the state illustrated in FIG. 6, the first front door 11 cannot be closed because the restriction claws 111*a*, 111*b* and 111*c* abut on the plate part 160*a* of the stop member 160. Thus, in order to close the first side door 13 to set the image forming part in an actuatable state, it is necessary to close the side door 13 first. When the side door 13 is closed, as illustrated in FIG. 7, the axial member 150 is pressed by the backside of the side door 13, and, thereby, the axial member 150 moves in X1-direction together with stop member 160.

Figure 7:
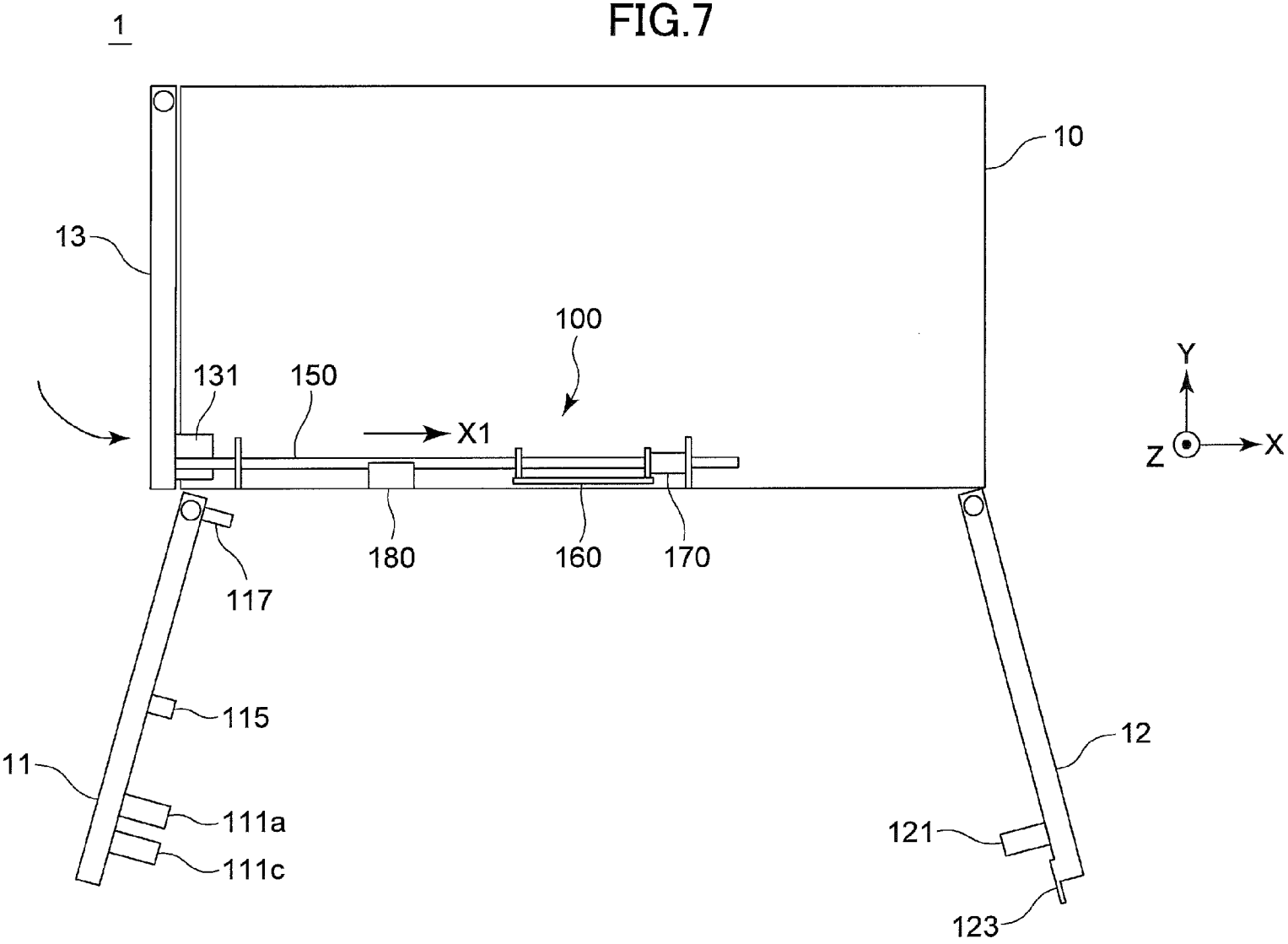
FIG. 7 is an illustration for explaining an operation of the interlocking mechanism.

In the state illustrated in FIG. 7, the first front door 11 cannot be closed because the restriction claw 111*c* provided on the backside of the first front door 11 abuts on the plate part 160*a* of the stop member 160. Thus, it is necessary to close the second front door 12 before closing the first front door 11.

Figure 8:
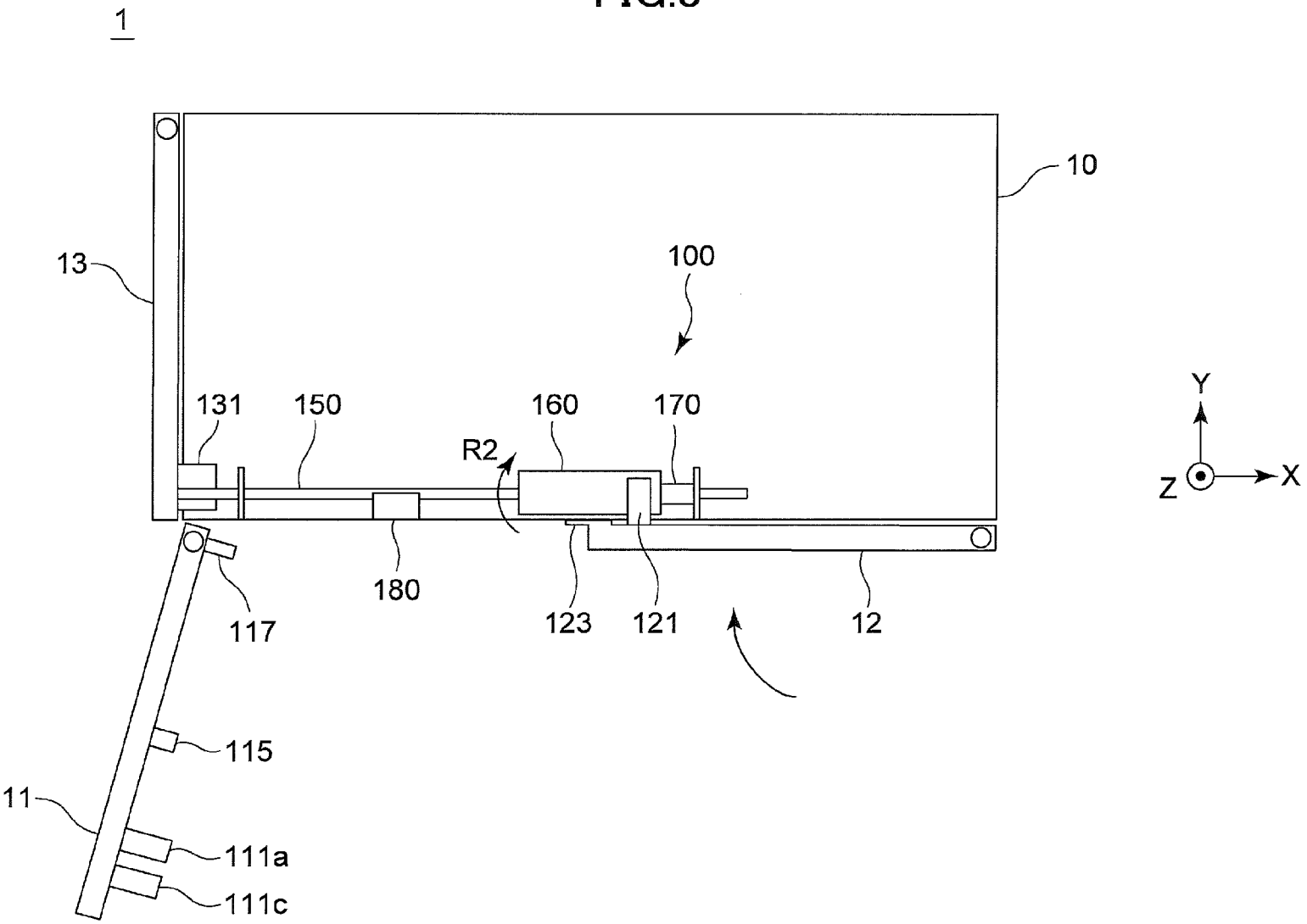
FIG. 8 is an illustration for explaining an operation of the interlocking mechanism.

When the second front door 12 is closed, as illustrated in FIG. 8, the stop member 160 is pressed by the pressing claw 121 provided on the backside of the second front door 12 and rotated in R2-direction. When the stop member 160 rotates, as illustrated in FIGS. 3 and 4, the restriction claw 111*c* provided on the backside of the first front door 11 does not contact with the stop member 160, thereby enabling the first front door to close.

As mentioned above, in the image forming apparatus 1, the first front door 11 cannot be closed due to the interlocking mechanism 100 before closing the side door 13 and the second front door 12. In other words, due to the operation of the interlocking mechanism 100, the first front door 11 is permitted to close only after closing the side door 13 and the second front door 12. Moreover, as mentioned above, if the first front door 11 is not opened beforehand, the second front door 12 and the side door 13 cannot be opened.

As mentioned above, the interlocking mechanism 100 prevents the image forming part from being actuated in a state where any one of the doors is open because the actuator 115 is not inserted into the interlock switch 180 if it is not in a state where all doors of the image forming apparatus 1 are closed. Thus, according to the interlocking mechanism 100 according to the present embodiment, the image forming part can be actuated in response to the open/closed state of a plurality of doors separately located from each other using one set of the actuator 115 and the interlock switch 180. Moreover, according to the interlocking mechanism 100, the safety of the image forming apparatus 1 can be maintained by a simple structure without increasing a cost because there is no need to provide an actuator and an interlock switch for each of a plurality of doors.

Note that the interlocking mechanism 100 may be used as an open/close detector to detect an open/closed state of the first front door 11, second front door 12 and side door 13. In this case, there is no need to provide an open/close detector separately from the interlocking mechanism 100, which can reduce a number of parts and a cost.

The interlocking mechanism 100 is applicable to various apparatuses having a plurality of doors other than the image forming apparatus 1.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. An interlocking mechanism configured to be provided to a housing having a rotatable first front door, a rotatable second front door and a rotatable side door, both the first and second front doors being arranged on a front surface of said housing to constitute a double door, the interlocking mechanism comprising:

an axial member configured to be provided on the front surface of said housing and reciprocate in a width direction of arrangement of said first and second front doors by linking with an opening and closing operation of said side door;

a stop member provided rotatably and fixed in the width direction to said axial member;

a restriction member configured to press said axial member toward said side door and having a urging member that urges said stop member in a first rotating direction;

a pressing claw provided on a backside of said second front door and configured to press said stop member in a second rotating direction in a state where said second front door and said side door are closed;

a restriction claw provided on a backside of said first front door and configured to abut on said stop member when said first front door is closed in a state where at least one of said side door and said second front door is open;

an interlock switch provided on said front surface of said housing and configured to be actuated by an actuator provided on the backside of said first front door being inserted into the interlock switch.

2. The interlocking mechanism as claimed in claim 1, further comprising a fixing mechanism configured to fix said side door to said first front door in a state where said first front door is closed.

3. The interlocking mechanism as claimed in claim 2, further comprising a collar part provided on the backside of said second front door and protruding toward said first front door in a state where said second front door is closed.

4. The interlocking mechanism as claimed in claim 1, wherein said urging member is a torsion coil spring.

5. The interlocking mechanism as claimed in claim 1, wherein said restriction member is provided on an upper part of the front surface of said housing.

6. An image forming apparatus, comprising:

an image forming part; and the interlocking mechanism as claimed in claim 1, wherein the interlock switch of said interlocking mechanism interlocks said image forming part.

7. The image forming apparatus as claimed in claim 6, further comprising a fixing mechanism configured to fix said side door to said first front door in a state where said first front door is closed.

8. The image forming apparatus as claimed in claim 7, further comprising a collar part provided on the backside of said second front door and protruding toward said first front door in a state where said second front door is closed.

9. The image forming apparatus as claimed in claim 6, wherein said urging member is a torsion coil spring.

10. The image forming apparatus as claimed in claim 6, wherein said restriction member is provided on an upper part of the front surface of said housing.

* * * * *